US005657775A

United States Patent [19]

Chou

[11] Patent Number: 5,657,775

[45] Date of Patent: Aug. 19, 1997

[54] STRUCTURE OF HAIRBRUSH

[76] Inventor: Kuo-Hua Chou, No. 17, Alley 10, Lane 118, Su-Wei Rd., Wu-Ku Hsiang, Taipei County, Taiwan

[21] Appl. No.: 599,726

[22] Filed: Feb. 12, 1996

[51] Int. Cl.[6] ..... A45D 24/30

[52] U.S. Cl. ..... 132/125; 132/150; 132/159; 132/142; 15/187; 15/207.2

[58] Field of Search ..... 132/125, 126, 132/137, 141, 142, 156, 161, 219, 120, 159, 160, 901; 119/630, 611, 613, 618; 15/142, 187, 188, 207.2; D28/21, 23, 28, 29, 30, 31, 34

[56] References Cited

U.S. PATENT DOCUMENTS

| | | | |
|---|---|---|---|
| Re. 21,985 | 12/1941 | McCoy | 132/161 |
| D. 47,147 | 3/1915 | Weiting | D28/21 |
| D. 192,282 | 2/1962 | Fluffer | D28/31 |
| 1,488,362 | 3/1924 | Sida | 132/125 |
| 1,958,802 | 5/1934 | Seaman | 132/125 |
| 2,633,591 | 4/1953 | Servilla | 132/142 |
| 3,872,873 | 3/1975 | Tupper | 132/159 |
| 4,423,531 | 1/1984 | Wall | 15/187 |
| 4,619,012 | 10/1986 | Wachtel | 15/187 |
| 5,018,542 | 5/1991 | Lee | 132/901 |

FOREIGN PATENT DOCUMENTS

| | | | |
|---|---|---|---|
| 1021071 | 6/1950 | France | 132/142 |
| 1253668 | 12/1967 | Germany | 15/207.2 |

*Primary Examiner*—Todd E. Manahan
*Assistant Examiner*—Eduardo C. Robert
*Attorney, Agent, or Firm*—Morton J. Rosenberg; David I. Klein

[57] ABSTRACT

A hairbrush is provided having a comb holder and plurality of teeth raised from the comb holder. A plurality of arched flexible bridging strips are respectively connected between each two adjacent teeth and arranged in rows. Each arched flexible bridging strip has a rounded head portion disposed above the topmost edges of the teeth. Each tooth has a plurality of longitudinal scraping grooves formed along its length for removing dirt and water from a user's hair when brushed.

3 Claims, 5 Drawing Sheets

STRUCTURE OF HAIRBRUSH

BACKGROUND OF THE INVENTION

The present invention relates to hairbrushes, and relates more particularly to such a hairbrush which has arched flexible bridging strips connected between the teeth to support the teeth against compression force and to simultaneously massage the skin of the head when brushing.

Conventional hairbrushes commonly comprise rows of teeth raised from the comb holder. Because the teeth are perpendicularly raised from the comb holder, they directly bear the compression force when brushing. Therefore, the teeth of conventional hairbrushes tend to be damaged when an excessive force is applied. Furthermore, during brushing the skin of the head tends to be hurt by the teeth.

SUMMARY OF THE INVENTION

The present invention has been accomplished to provide a hairbrush which eliminates the aforesaid drawbacks. It is one object of the present invention to provide a hairbrush which has meant to bear most of the compression force applied to the teeth. It is another object of the present invention to provide a hairbrush which does not hurt the skin of the head when brushing. It is still another object of the present invention to provide a hairbrush which massages the skin of the head when brushing.

According to one aspect of the present invention, the hairbrush comprises a comb holder and plurality of teeth raised from the comb holder wherein a plurality of arched flexible bridging strips are respectively connected between each two adjacent teeth and arranged in rows, each arched flexible bridging strip having a rounded top disposed above the topmost edges of the teeth.

According to another aspect of the present invention, each of the teeth has a plurality of longitudinal scraping groove for removing dirts and water from the hair when brushing.

DETAILED DESCRIPTION OF THE PREFERRED EMBODIMENTS

Figure 1A:
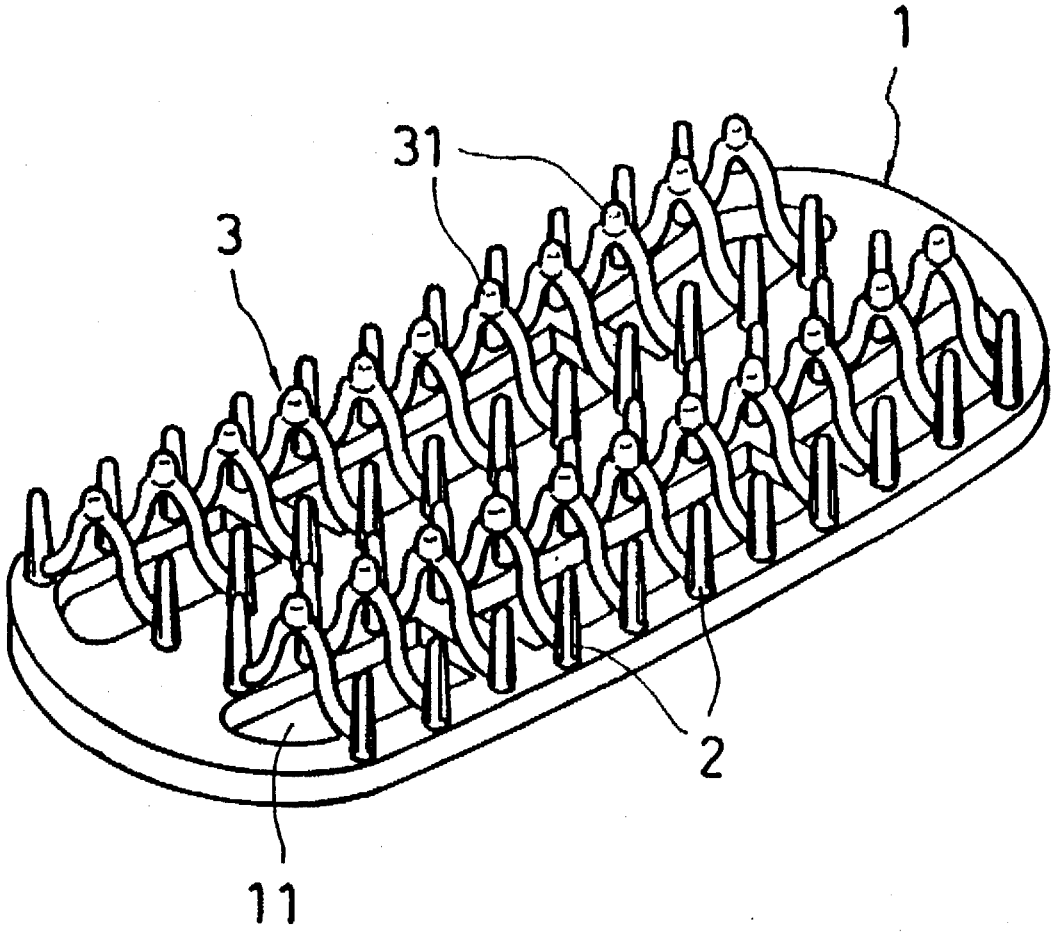
FIG. 1A is an elevational view of a comb holder according to a first embodiment of the present invention.
Figure 1B:
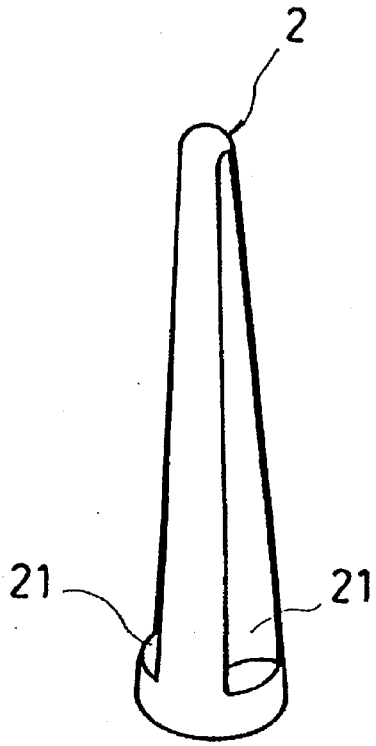
FIG. 1B is an elevational view of one tooth of the comb holder shown in FIG. 1A.

Referring to FIGS. 1A and 1B, the comb holder, referenced by 1, comprises six longitudinal slots 11, two pairs of parallel rows of teeth 2 respectively and longitudinally disposed along two opposite sides of each longitudinal slot 11, and rows of substantially arched flexible bridging strips 3 respectively bridging over each longitudinal slot 11 and connected between each two symmetrical teeth 2. Each of the arched flexible bridging strips 3 has a rounded top 31 disposed above the elevation of the topmost edges of the teeth 2. Each of the teeth 2 has a plurality of longitudinal scraping grooves 21 along the length. When brushing the hair, the arched flexible bridging strips 3 and the teeth 2 are forced to separate tangled threads of hair, the scraping grooves 21 of the teeth 2 are simultaneously forced to scrap of dirts and water from the hair, and at the same time the rounded heads 31 of the arched flexible bridging strips 3 are forced to rub against the skin of the head without causing any hurt to the cells of the skin. The arched flexible bridging strips 3 and the teeth 2 are integrally molded on the comb holder 1. When brushing, the arched flexible bridging strips 3 bear most of the compression force applied to the teeth 2, therefore the teeth 2 do not deform easily.

Figure 2:
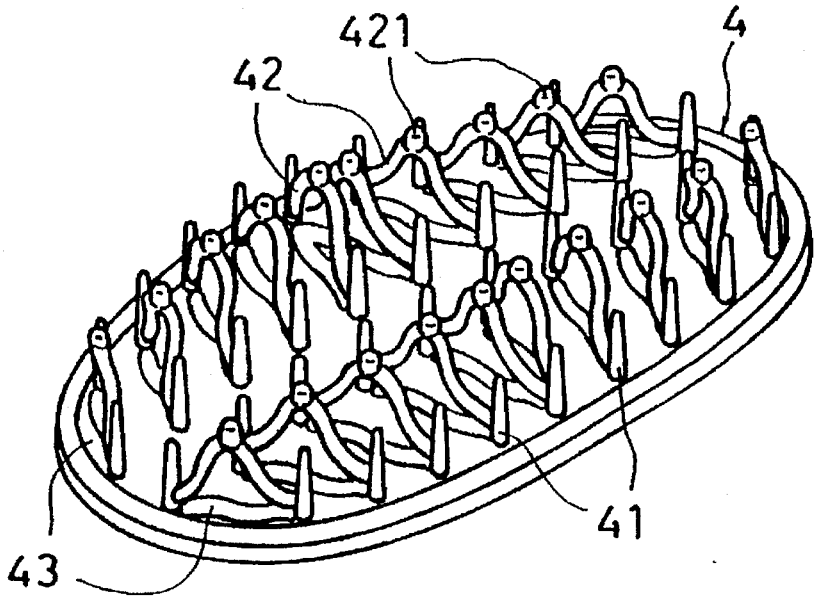
FIG. 2 is an elevational view of a comb holder according to a second embodiment of the present invention.
Figure 3:
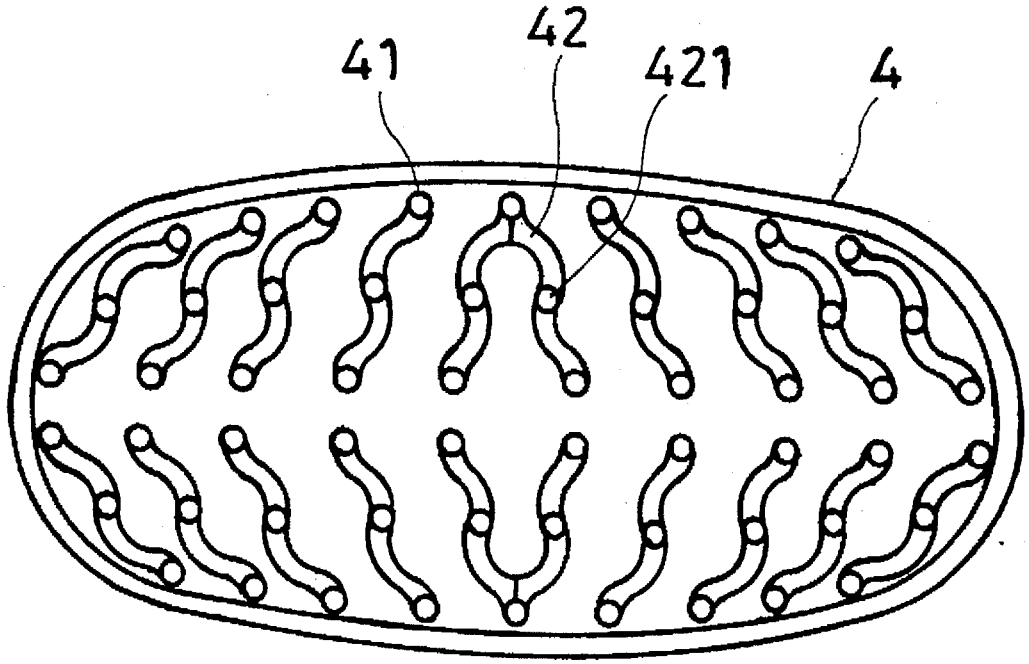
FIG. 3 is a top view of the comb holder shown in FIG. 2.
Figure 4:
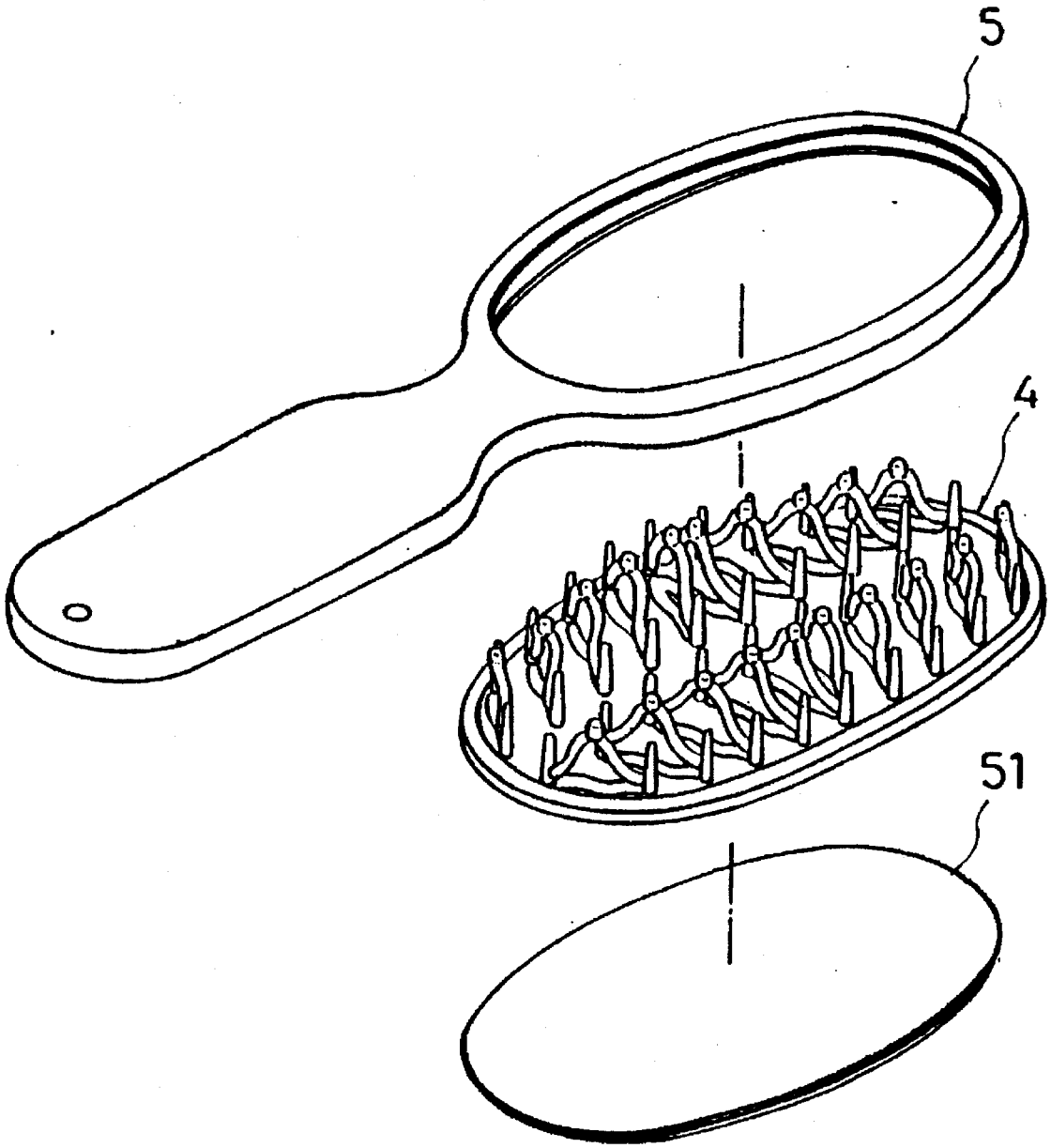
FIG. 4 is an exploded view of a hairbrush according to the second embodiment of the present invention.

FIGS. 2, 3, and 4 show an alternate form of the present invention. As illustrated, the comb holder, referenced by 4, is mounted in a frame 5 and supported on a base plate 51, having two pairs of longitudinal rows of teeth 41, a plurality of transverse slots 43 respectively connected between the teeth, and two symmetrical rows of substantially arched flexible bridging strips 42 respectively connected between two teeth 41 and bridging over two opposite ends of each transverse slot 43. Each of the arched flexible bridging strips 42 has a rounded head 421 disposed at an elevation above the topmost edges of the teeth 41. Each pair of longitudinal rows of teeth 41 include an outer longitudinal row of teeth and an inner longitudinal row of teeth, wherein the inner longitudinal row of teeth has one more tooth than the outer longitudinal row of teeth, and the pitch between each two adjacent teeth of the outer longitudinal row of teeth is shorter than that of the inner longitudinal row of teeth, and therefore the tooth in the middle of the outer longitudinal row of teeth is connected to two adjacent teeth of the inner longitudinal row of teeth by two arched flexible bridging strips and, the arched flexible bridging strips are symmetrically and obliquely disposed at two opposite sides (see FIG. 3). When viewed from the top as shown in FIG. 3, each arched flexible bridging strip 42 has a substantially S-shaped profile.

Figure 5:
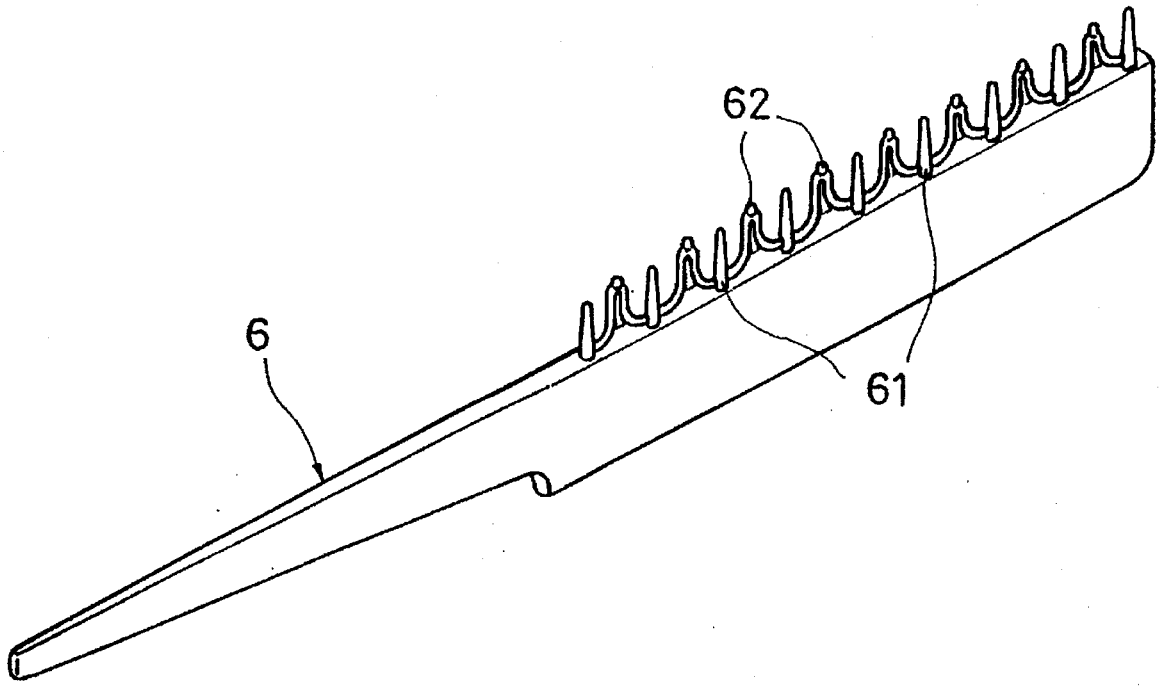
FIG. 5 is an elevational view of still another alternate form of the present invention, showing one row of teeth raised from the handle-like comb holder, and arched flexible bridging strips connected between each two adjacent teeth.

FIG. 5 shows still another alternate form of the present invention. According to this alternate form, the comb holder 6 is made in the shape of an elongated, narrow handle having a longitudinal line of teeth 61, and a plurality of substantially arched flexible bridging strips 62 respectively connected between each two adjacent teeth 61.

It is to be understood that the drawings are designed for purposes of illustration only, and are not intended as a definition of the limits and scope of the invention disclosed.

I claim:

1. A hairbrush comprising a comb holder, a plurality of raised teeth extending from said comb holder to a topmost edge thereof, and a plurality of arched flexible bridging strips arranged in rows, each of said arched flexible bridging strips extending between a respective pair of adjacent teeth respectively coupled to opposing ends thereof, each of said arched flexible bridging strips having a rounded head portion disposed intermediate said opposing ends thereof and extending beyond said topmost edges of said teeth, each tooth having a plurality of longitudinally extended scraping grooves formed therein for removing dirt and water from a user's hair when brushed.

2. A hairbrush comprising a comb holder, a plurality teeth extending from said comb holder, and a plurality of arched flexible bridging strips arranged in rows and respectively connected between pairs of adjacent teeth, each arched flexible bridging strip having a rounded head portion disposed at an elevation above a topmost edge of each of said plurality of teeth, each tooth having a plurality of longitudinal scraping grooves for removing dirt and water from a user's hair when brushed, said plurality of teeth being arranged into pairs of longitudinal rows, each pair of longitudinal rows including an outer longitudinal row of teeth and an inner longitudinal row of teeth, said inner longitudinal row of teeth having one more tooth than said outer longitudinal row of teeth, and a pitch between each two adjacent teeth of said outer longitudinal row of teeth being shorter than that of said inner longitudinal row of teeth, a tooth in a middle portion of said outer longitudinal row of teeth being connected to two adjacent teeth of said inner longitudinal row of teeth by two arched flexible bridging strips, each of said plurality of arched flexible bridging strips having a substantially S-shaped longitudinal contour.

3. A hairbrush comprising a handle, a longitudinal row of teeth extending from one end of said handle, and a plurality of arched flexible bridging strips arranged in said row, each of said arched flexible bridging strips extending between a respective pair of adjacent teeth respectively coupled to opposing ends thereof, each of said arched flexible bridging strips having a rounded head portion disposed intermediate said opposing ends thereof and extending beyond a topmost edge of each of said teeth.

* * * * *